US005273306A

United States Patent [19]

Wawra

[11] Patent Number: 5,273,306

[45] Date of Patent: Dec. 28, 1993

[54] FRONT JAW

[75] Inventor: Reinhold Wawra, Vienna, Austria

[73] Assignee: HTM Sport- und Freizeitgeraete Gesellschaft m.b.H., Schwechat, Austria

[21] Appl. No.: 969,233

[22] PCT Filed: Mar. 25, 1992

[86] PCT No.: PCT/EP92/00652

§ 371 Date: Jan. 11, 1993

§ 102(e) Date: Jan. 11, 1993

[87] PCT Pub. No.: WO93/04743

PCT Pub. Date: Mar. 18, 1993

[30] Foreign Application Priority Data

Aug. 28, 1991 [AT] Austria ..... 1687/91

[51] Int. Cl.[5] ..... A63C 9/085

[52] U.S. Cl. ..... 280/625; 280/628; 280/634

[58] Field of Search ..... 280/623, 625, 626, 628, 280/634, 611

[56] References Cited

U.S. PATENT DOCUMENTS

| | | | |
|---|---|---|---|
| 3,690,690 | 9/1972 | Marker | 280/11.35 T |
| 4,989,893 | 2/1991 | Kowatsch et al. | 280/625 |
| 5,033,768 | 7/1991 | Stritzl | 280/628 |
| 5,149,124 | 9/1992 | Wittmann et al. | 280/625 |
| 5,193,841 | 3/1993 | Stritzl et al. | 280/625 |

FOREIGN PATENT DOCUMENTS

| | | |
|---|---|---|
| 0408855 | 1/1991 | European Pat. Off. . |
| 2161881 | 6/1972 | Fed. Rep. of Germany . |

*Primary Examiner*—Richard M. Camby

*Attorney, Agent, or Firm*—Flynn, Thiel, Boutell & Tanis

[57] ABSTRACT

The invention relates to a front jaw (1) comprising a housing (2), in which is housed a release spring (40). The spring loads a pull rod (10) extending through it, which pull rod acts through a release plate (13) onto the shorter lever arms (36) of two toggle levers (35) which are pivotal about vertical axes (34) on a support part (20), and the longer lever arms of which are designed as sole holders (37). The support part (20) has an opening (21) for the pull rod (10) and has a front support surface (23) which partly rests on a rear crosswall (3) of the housing (2). In order to protect such a front jaw (1) against the penetration of snow and dirt on the side facing the shoe, the invention provides that on the housing (2) on the side facing a ski shoe there is arranged a path-defining means (8) for the release plate, and that an approximately vertically upwardly extending cover plate (80) is connected to the path-defining means (8), the upper end section (81) of which cover plate is bent forwardly at least in certain areas. It is furthermore important according to the invention that an open area (90) permitting the movement of the release plate (13) is formed between the cover plate (80) and the release plate (13).

3 Claims, 2 Drawing Sheets

FRONT JAW

FIELD OF THE INVENTION

The invention relates to a front jaw.

BACKGROUND OF THE INVENTION

Such a front jaw has, for example, been described in EP-A2 0 408 855.

The technical solution disclosed in this reference has proven to be successful, however, the desire exists to further improve this front jaw since the penetration of snow and dirt on the side facing the ski shoe is supposed to be prevented as much as possible.

It has already been suggested to build a ski binding with a housing closed on all sides (see DE-OS 19 38 567). However, this solution has the disadvantage that the structural possibilities with respect to the directions of movement are very limited. Such a solution is, therefore, out of the question for a front jaw with toggle levers of this type.

It is furthermore known from DE-OS 21 61 881 to close off the open spaces between movable ski binding parts and the ski binding housing with a bellows. This solution was not successful in reality since such bellows could not withstand the rough operating conditions of a ski binding. Furthermore, such bellows are only suited for simple designs.

SUMMARY OF THE INVENTION

The goal of the invention is to avoid these disadvantages and to protect a front jaw of the above-mentioned type in a simple manner against the penetration of dirt and snow.

This purpose is attained according to the invention by the characterizing characteristics of claim 1. Due to the fact that an approximately vertically upwardly projecting cover plate is connected to a path-defining means for the release plate, which path-defining means is arranged on the housing of the ski binding, the upper end section of which cover plate is bent forwardly at least in certain areas, the ski binding is protected against the penetration of dirt and snow on the side facing a ski shoe to be inserted.

An elastic insert by itself is known from DE-OS 37 42 483. However, this known solution has the disadvantage that, on the one hand, the elastic insert has a complicated shape and that it, on the other hand, can be easily damaged by outside mechanical influences (ice, stones, steel edges).

It has proven to be particularly advantageous when the insert consists of a foam material, preferably of a closed-cell polyethylene foam material.

BRIEF DESCRIPTION OF THE DRAWINGS

Further advantages, characteristics and details of the front jaw of the invention will now be described in greater detail in connection with the drawings, in which.

DETAILED DESCRIPTION OF THE INVENTION

Figure 1:
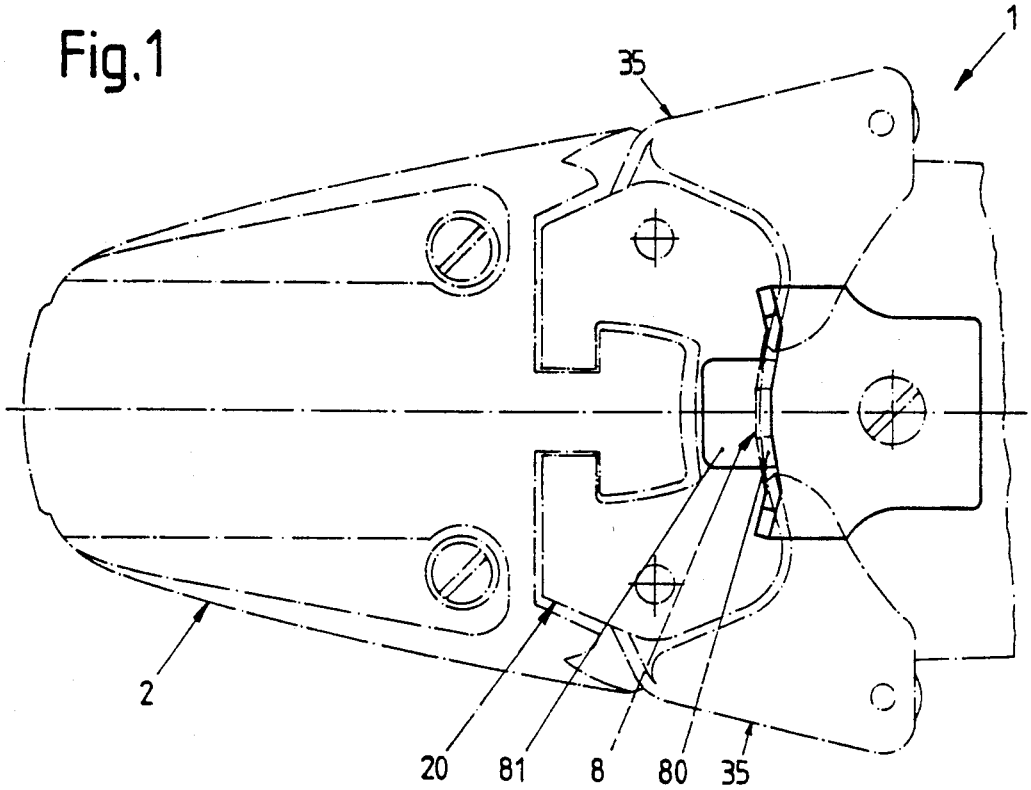
FIG. 1 is a top view of parts of the front jaw of the invention.
Figure 2:
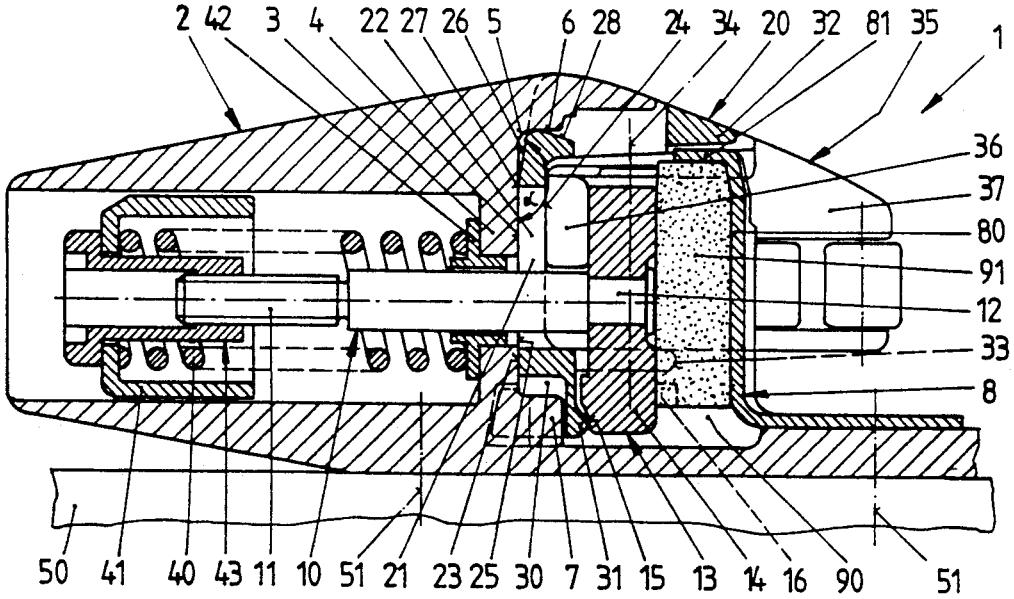
FIG. 2 is a longitudinal central cross-sectional view of the front jaw in the position of the ski binding, in which it is ready to be stepped thereinto.

FIGS. 1 and 2 show the front jaw 1 of the invention in the position in which it is ready to be stepped thereinto. Individual parts, which are without any importance for the present invention, have thereby only been schematically indicated or were left out for the purpose of a better clarity. The front jaw 1 has a housing 2 which is fastened on a ski 50 by means of screws 51 (only schematically indicated). A release spring 40 is housed in the housing 2, the initial tension of which release spring can be adjusted in a conventional manner by an adjusting device 43. The release spring 40 is arranged between a spring plate 41 and, with the interpositioning of a bearing sleeve 42, a vertically extending rear crosswall 3 of the housing 2. A pull rod 10 extends in axial direction through the release spring 40, the one end 11 of which pull rod cooperates with the adjusting device 43 and the other end 12 of which pull rod is connected to an essentially vertically extending release plate 13. The release plate 13 has at its lower end 14 a control surface 15 directed toward the tip of the ski and a stop 16 pointing rearwardly in direction of a ski shoe to be inserted.

The vertically extending rear crosswall 3 of the housing 2 is followed at the top by a first curved section 5 and thereafter a horizontally rearwardly extending section 6. A support part 20 rests with its support wall 22 on the back side 4 of the rear crosswall 3 of the housing 2 in the position of the front jaw 1, in which position the front jaw is ready to be stepped into. The support part 20 is frame-shaped viewed from the rear, namely, it has a through opening 21 for the pull rod 10, and has—viewed in the side view—approximately the shape of a C. The vertically extending section of the C is formed by the support wall 22 and is equipped with a front support surface 23 and a rear support surface 24. Two axes 34 for the toggle levers 35 are arranged symmetrically with respect to the longitudinal central axis of the front jaw 2 in the upper and lower legs 32, 33 of the C. The shorter lever arms 36 of the two toggle levers 35 are supported on the one side thereof on the release plate 13 and on the other side thereof on the rear support surface 24 of the support part 20. The longer lever arms of the toggle levers 35 are designed as sole holders 37 to rest on the sole of a ski shoe. The front support surface 23 of the support part 20 has two sections adjacent to one another in elevational direction, with the lower section 25, viewed in the position of the front jaw 2, in which it is ready to be stepped thereinto, resting on the back side 4 of the rear crosswall 3 of the housing 2. The upper section 26 defines an obtuse angle $\alpha$ with the lower section 25. The support part 20 has a tilting edge 27 between the upper section 26 and the lower section 25. The upper leg 32 of the support part 20 is equipped in the section of the longitudinal central axis with a rearwardly and downwardly inclined surface 28. The support part 20 is in its lower section, in the area of the longitudinal central axis, designed fork-shaped in the top view and has a forwardly open recess 30 and a rearwardly directed projection 31. A corresponding keylike projection 7 of the housing 2 is associated with the recess 30. A path-defining means 8 facing the release plate 13 is furthermore arranged on the housing 2. An approximately vertically upwardly extending cover plate 80 follows the path-defining means 8. An upper end section 81 of the cover plate 80 is bent forwardly in an area near the longitudinal central axis of the binding. In order to enable a movement of the release plate 13 in longitudinal direction of the ski in the case of a load, an open space 90 is provided between the vertically upwardly extending cover plate 80 and the release plate 13. An elastically flexible insert 91 is arranged in the open space 90. The insert 91 is made of a moisture-repellent plastic. A closed-cell foam material of polyethylene is proven to be particularly suited. The insert 91 is punched or is cut out of a foam material mat having a suitable thickness in a shape fitting the open space 90 and essentially fills the open space 90.

Figure 3:
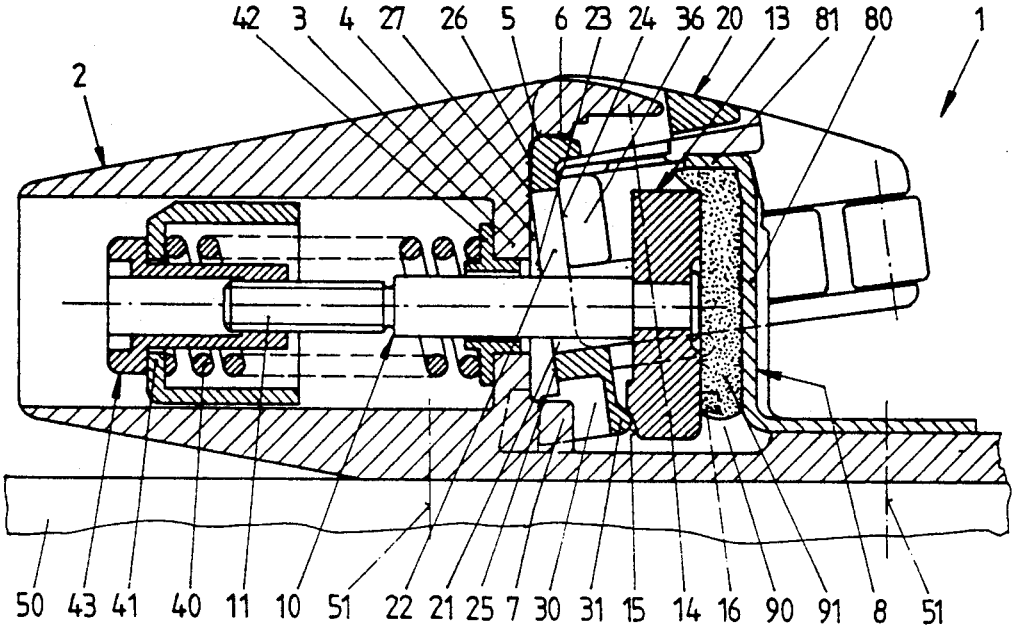
FIG. 3 is the same view with an upwardly pivoted sole holder.

FIG. 3 shows how the support part 20 and the toggle lever 35 are pivoted during a upwardly directed increased force, for example, during a backward fall or backward twisting fall. The support part 20 is thereby pivoted about the tilting edge 27 against the force of the release spring 40. The release plate 13 is thereby released from the shorter lever arms 36 of the toggle levers 35. By moving the release plate 13 rearwardly, the insert 91 is slightly compressed. By using a correspondingly easily deformable foam material, as stated above, the release values of the ski binding are thereby not negatively influenced. As soon as the front jaw returns into the position ready to be stepped thereinto (see FIG. 2), the insert 91 also assumes again its original shape.

I claim:

1. In a front jaw (1) comprising a housing (2) fastenable on a ski (50), in which housing is housed a release spring (40) and through which housing extends a pull rod (10) loaded by the release spring (40), which pull rod acts through a release plate (13) onto shorter lever arms (36) of two toggle levers (35), which are arranged pivotally about vertical axes (34) on a support part (20) and longer arms of sole holders (37) for a ski shoe, with the support part (20) having a through opening (21) for the pull rod (10), and with the support part (20) having a front support surface (23) resting at least partially on a rear crosswall (3) of the housing (2), which rear crosswall (3) of the housing (2) extends essentially vertically, the improvement wherein a path-defining means (8) for the release plate (13) is arranged in a conventional manner on the housing (2) in its lower area on the side facing the ski shoe to be inserted, wherein an approximately vertically upwardly projecting cover plate (80) is connected to the path-defining means (8), the upper end section (81) of which is bent forwardly at least in certain areas, and wherein between the cover plate (80) and the release plate (13) there is formed an open space (90) permitting the movement of the release plate (13) in longitudinal direction of the ski.

2. The front jaw according to claim 1, wherein an insert (91) of an elastically flexible, moisture-repellent material is arranged at least in certain areas in the open space (90), and that the insert (91) is cut or punched out of this material.

3. The front jaw according to claim 2, wherein the elastically flexible material is a material, preferably a closed-cell foam material of polyethylene.

* * * * *